US008988475B2

(12) United States Patent
Alhashem et al.

(10) Patent No.: US 8,988,475 B2
(45) Date of Patent: Mar. 24, 2015

(54) INKLESS PRINTER

(71) Applicants: Mayadah Alhashem, Santa Barbara, CA (US); Ahmad Bayonis, Riyadh (SA); Ye Yuan, Kunming (CN); Charmaine Bennett, Pointe-a-Pierre (TT)

(72) Inventors: Mayadah Alhashem, Santa Barbara, CA (US); Ahmad Bayonis, Riyadh (SA); Ye Yuan, Kunming (CN); Charmaine Bennett, Pointe-a-Pierre (TT)

( * ) Notice: Subject to any disclaimer, the term of this patent is extended or adjusted under 35 U.S.C. 154(b) by 27 days.

(21) Appl. No.: 13/827,760

(22) Filed: Mar. 14, 2013

(65) Prior Publication Data

US 2014/0267533 A1 Sep. 18, 2014

(51) Int. Cl.

| | |
|---|---|
| ***B41J 2/35*** | (2006.01) |
| ***B41J 2/435*** | (2006.01) |
| ***B41J 2/47*** | (2006.01) |

(52) U.S. Cl.

CPC ..... *B41J 2/473* (2013.01)
USPC ..... 347/211; 347/224

(58) Field of Classification Search

USPC ..... 347/211, 224, 234, 235, 237, 243, 245, 347/247, 263

See application file for complete search history.

(56) References Cited

U.S. PATENT DOCUMENTS

| | | | | |
|---|---|---|---|---|
| 3,461,229 | A | 8/1969 | Oppenheimer | |
| 3,465,352 | A | 9/1969 | Carlson et al. | |
| 3,613,464 | A | 10/1971 | Archer | |
| 4,403,235 | A * | 9/1983 | Fedder et al. | 347/259 |
| 4,520,370 | A | 5/1985 | Fujii et al. | |
| 6,195,113 | B1 * | 2/2001 | Hoover | 347/235 |
| 7,432,946 | B2 | 10/2008 | Morikawa et al. | |
| 7,495,682 | B2 | 2/2009 | Kohchi et al. | |
| 2005/0110862 | A1 * | 5/2005 | Yamaguchi | 347/246 |
| 2006/0164505 | A1 * | 7/2006 | Maeda | 347/234 |
| 2006/0290774 | A1 * | 12/2006 | Wittenberg et al. | 347/243 |
| 2009/0120218 | A1 | 5/2009 | Tokuchi et al. | |
| 2010/0165068 | A1 * | 7/2010 | Yamaguchi | 347/243 |

* cited by examiner

*Primary Examiner* — Kristal Feggins
(74) *Attorney, Agent, or Firm* — Oblon, McClelland, Maier & Neustadt, L.L.P.

(57) ABSTRACT

An inkless printing device that comprises a plurality of lasers, a rotating polygonal mirror, and an energy recycling unit. The mirror rotates and reflects a laser beam in a manner that allows the beams to reach any point on the paper. The laser turns ON and OFF while the mirrors are rotating to form a printout. Printing on a sheet of paper is achieved by burning to a certain pre-determined depth of the paper, by using the thermal properties of a laser. The energy recycling unit converts the heat energy generated during the printing process to electrical energy and charges a battery cell. Upon the battery cells being charged to a pre-determined power threshold, the power supply to the printer is changed from the AC supply to the battery supply.

9 Claims, 6 Drawing Sheets

INKLESS PRINTER

GRANT OF NON-EXCLUSIVE RIGHT

This application was prepared with financial support from the Saudia Arabian Cultural Mission, and in consideration therefore the present inventor(s) has granted The Kingdom of Saudi Arabia a non-exclusive right to practice the present invention.

BACKGROUND

1. Field of the Disclosure

The present disclosure relates to an inkless printing device. Specifically, a laser printer that forms an image on a substrate such as paper by oxidizing the substrate and/or thermally degrading the substrate.

2. Description of the Related Art

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

Ink has always been a vital component in the field of printing. Commonly used printers such as the ink-jet and laser printers still rely on ink and toner to complete the printing tasks. Ink jet printers typically comprise a 'print-head' that scans a page in horizontal strips, using the printer's motor assembly to move the ink cartridges back and forth over the paper, while it is rolled up in the vertical direction. As a row of the image is printed, the paper moves in order to print the next row. Although widely used, some issues such as paper jams, smudging of ink on the paper and slow printing speeds are inherent to ink jet printers.

Laser printers are significantly faster than traditional ink jet printers and employ a cylinder, a laser source, a fine powder called toner, a total charge source and a fuser. The surface of the cylinder has high photoconductivity. The cylinder is initially given a total charge by the total charge source and when photons impact the cylinder, it discharges the surface, and reverses the charge. The laser imprints patterns onto a drum as it revolves and the reversely charged patterns attract the powder (toner), and presses the toner onto the sheets of paper. Finally, as the paper is rolled under a heated wire called the fuser, the toners are melted and printed onto the paper.

Although laser printers achieve faster print speeds, they also have inherent disadvantages. For instance, the complex structure of the laser printer contributes to its high price and bulky size. The high cost of toners and the large energy consumption of the laser printers separate them from ideal household printers. Further, modern laser printers generate a large amount of heat during the printing process. This wasted energy negatively impacts the environment.

Furthermore, in the case of the ink spread by the ink jet printers or the toner utilized by laser printers, some kind of foreign substance is introduced onto the surface of the paper to complete the process of printing. Both the toners for the laser printers and the ink cartridges for the ink-jet printers are costly, and may have damaging effects on the environment that cannot be ignored. For example, the production and disposal of empty toner and ink cartridges leave non-biodegradable waste as well as their toxic contents.

Finally, ink is becoming one of the most expensive liquid on market, with the price increasing from $0.73 per mL to $3.00 per mL in a span of a couple of decades. In fact multinational corporations and even individual consumers are spending more money to purchase ink and toner for their printers. Moreover, the manufacturing, packaging, and disposal of toners and ink cartridges impact negatively on the environment by contributing to the global electronic waste.

SUMMARY

In light of the above observations made by the present inventor(s), an apparatus is described in the present disclosure that relies on the thermal properties of a laser to leave impressions on paper to perform the printing. Specifically, the apparatus referred to as the 'Blazer printer', prints data on the paper by oxidizing or chemically changing the surface of the paper to a certain predetermined depth by the heat of a laser. In this manner, the Blazer printer forms an image on paper without the use of ink or toner in the printing process, and avoids the amount of hazardous chemicals involved in the disposal process of ink cartridges. The Blazer Printer is thus capable of making a positive impact on the environment.

The main design of the Blazer printer comprises one or more lasers pointed at rotating mirrors that together form a hexagon shape. These mirrors rotate and reflect a laser beam in a manner that allows the beams to reach any horizontal point on the paper. The lasers turn ON/OFF while the mirrors are rotating, to form the print out of the image on the paper. Further, thermoelectric coolers that are placed underneath the laser beams that convert the generated heat into electricity to increase the energy efficiency of the Blazer printer.

In what follows, we present different embodiments of the Blazer printer, to address different consumer needs. The embodiments vary in the number of lasers, movement of the lasers, and/or movement of the paper. Consequently, they differ in speed, precision, and energy efficiency. Generally, the Blazer printer requires components of relatively smaller size and therefore as compared to the conventional printers are less bulky.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE EMBODIMENTS

Figure 1:
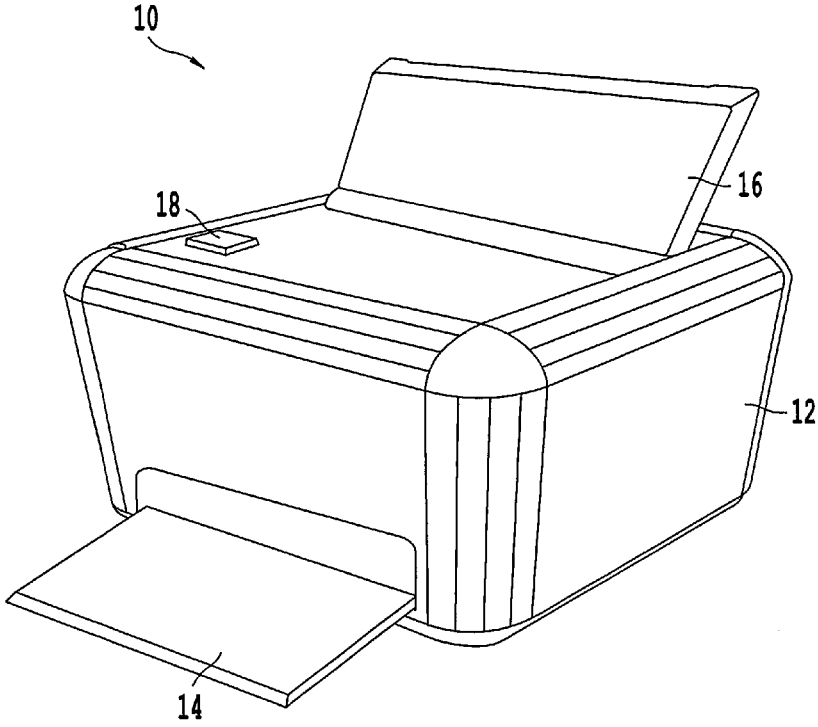
FIG. 1. depicts an exterior frame design of the Blazer printer.

Referring now to the drawings, like reference numerals designate identical or corresponding parts throughout the several views.

FIG. 1 depicts a frame design for the Blazer printer. The exterior of the Blazer printer, 10, is made from recycled plastics. This reduces the manufacturing cost and also decreases the amount of plastics produced. Recycled plastic can be melted and remolded into the desired casing for the printer, 12. Further, a protective coating is applied to the surface of the printer and can be chosen from a variety of colors.

An LED screen 18, is installed in one corner on the top surface of the Blazer printer. Note that the position of the LED screen is in no way limiting the use of the Blazer printer. Any other position for the screen will suffice as long as a user can operate and visually see the commands displayed by the screen. The screen is connected to the processing chip (not shown in figure) to display real-time printer settings, printer status, battery level and other pertinent information such as the size of the paper, the margin settings of the paper and can also be used to display an image, while it is being printed. Further, a plurality of buttons are provided next to the LED screen to allow the user perform some basic functions such as a manual shut down the printer, select options for printing a particular document and the like. Note that most of the commands processed by the Blazer printer are computer initiated.

The computer terminal may be hard-wired to the printer or can remotely access the printer via blue tooth technology. In order to enable the wireless mechanism of connecting to the printer, a wireless receiver is provided within the Blazer printer. Further, an indicator showing the status of the wireless connection is provided next to the LED display to enable the user to quickly check if a specific computer terminal is connected to the Blazer printer.

The Blazer printer is equipped with a set of paper trays 14 and 16 which are also made from recycled plastic. Paper tray 14, is an input tray which feeds in paper to the blazer printer and paper tray 16 is a receiving tray where the user can collect the printed documents.

Figure 2:
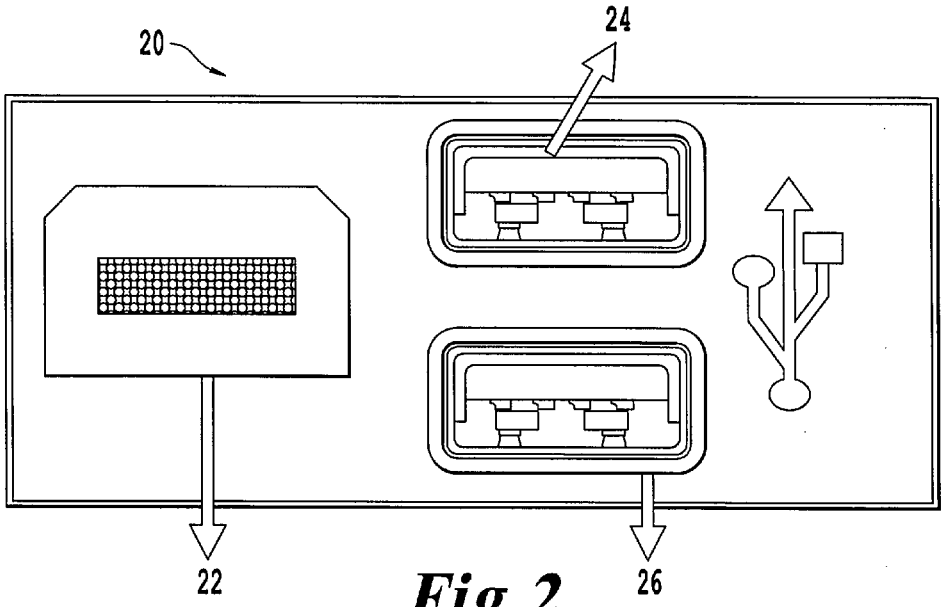
FIG. 2. depicts the rear frame of the Blazer printer, illustrating the external ports available for printing.

FIG. 2 illustrates schematically the rear panel of the Blazer printer. The rear panel comprises a power socket 22, and a plurality of USB (3.0) ports labeled 24 and 26. These data transferring ports are connected with the processing chip of the Blazer printer. The USB ports allow the user to directly print information (data) from the USB memory without sending any commands from the computer. Note, that while printing directly from the USB memory, the user can operate the USB's memory by using the menu on the printer's LED screen. Further, a power socket 22 is also provided that connects with the power outlets via an AC/DC converter.

The interior of the printer (not shown) comprises of a battery pack, a paper transferring mechanism, a laser printing mechanism (to be discussed), and an energy recycling component (to be discussed).

The lithium ion batteries are installed in the back of the printer case. Electricity produced from the energy recycling component is temporarily stored in the batteries. Once the pre-determined charge level is reached, the printer will switch its power source to batteries to reduce energy consumption. The lithium battery cells may also serve as the main power source for a portable model of the Blazer printer. A set of feed rollers and a two-stepper motor are installed inside the plastic casing of the printer to guide the paper from the tray 14, to the printer. Note that the paper feeding mechanism is intentionally simplified so as to minimize the possibility of paper jam at high speed printing.

The rollers move the paper underneath the laser head, as the lasers quickly scans over the paper and prints information. Once the printing is complete, the sheets of paper are then transferred out of the printer and can be collected in the collecting tray 16.

Figure 3:
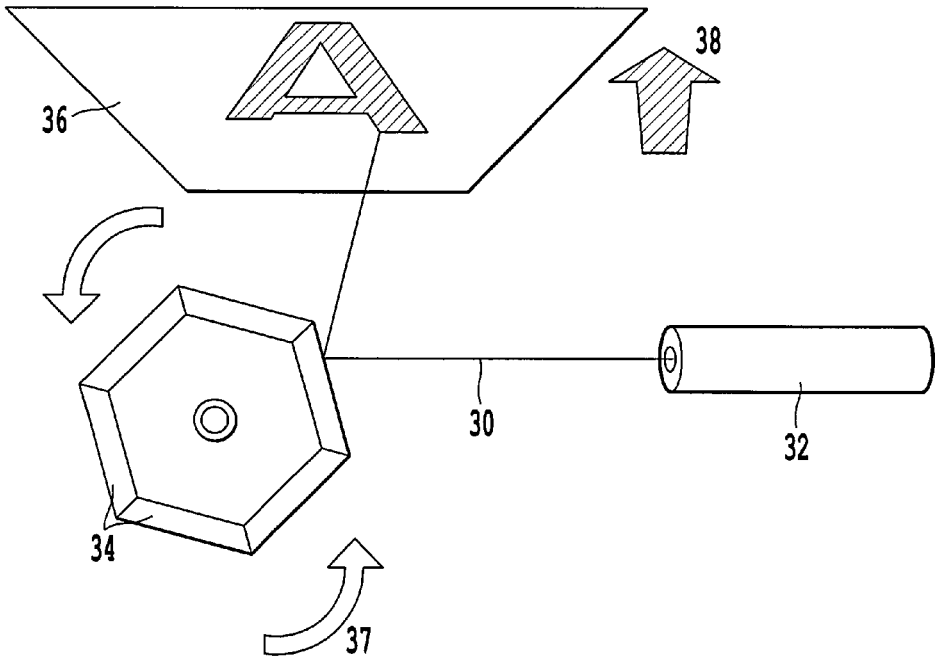
FIG. 3. illustrates a non limiting example depicting the structure of the Blazer printer according to one embodiment of the present disclosure.

FIG. 3 depicts a non limiting example illustrating the structure of the internal components of the Blazer printer according to one embodiment of the present disclosure.

A powerful laser beam 30, is projected from a stationary laser 32, onto a rotating polygonal mirror 34. The mirror rotates and reflects the laser beam from one end of the paper (margin) to the other, while the paper 36, is rolled underneath the laser in the direction depicted by 38. Note that the position of the polygonal mirror is also adjustable to print different margins.

In this mechanism of using a single stationary laser that is mounted near the paper, an electric current converter converts the alternating current (AC) to a direct current (DC), and at the appropriate voltage, powers the laser. Lasers that can be used in the Blazer printer are of the argon-ion, and helium-neon gas laser types. Their wavelengths range from 518 nm (nanometers) to 633 nm. At the right intensities, these lasers will be suitable for making impressions on the paper in a short time period.

Further, a lens (not shown in the figure) is used to focus the light generated from laser and direct it to a specific point on the paper where data is to be printed. The power of the laser beam is adjusted accordingly to the printing speed to ensure that only the surface of the paper will be burned.

The advantage of employing a rotating mirror is its cost efficiency. Since the printer requires at most one laser, it decreases the overall complexity of the mechanism and also reduces the bulkiness of the printer. However, compared to other laser arrangements (to be discussed) the rotating mirror has a relatively lower printing speed. Thus there is a trade-off between speed and customization.

The substrate on which an image is formed by the Blazer printer is sensitive to heat such that exposure to intense laser light causes the substrate to change color, transparency and/or reflectivity. The substrate can be any material that is capable of changing color, transparency and/or reflectivity on exposure to intense laser light. For example the substrate may be a plastic (e.g., a polyolefin), a metallic film, a film of fibers and the like.

Preferably the substrate is paper. The paper rapidly increases in temperature when contacted with the laser light. The temperature is sufficient to discolor the paper and thereby create an image. Discoloration occurs when the paper is burned, oxidized or otherwise changed through the thermal action of the laser light. Importantly the substrate does not contain a layer of heat sensitive material such as that conventionally used in thermal printers. Instead, image formation is achieved through chemical transformation of the substrate. In the case of paper cellulose fibers are preferably at least partially oxidized and/or thermally degraded by the laser light. Preferably the chemical modification and/or partial oxidation occurs on cellulose fibers that are present throughout the paper substrate and not just on the surface of the paper.

In the context of the present disclosure "burning" means heating to a temperature such that cellulose fibers of paper are discolored by thermal degradation, pyrolysis and/or oxidation.

The laser may briefly heat the substrate, e.g., paper, to a temperature that is slightly lower than the temperature at which the substrate ignites and burns. The substrate may undergo pyrolysis if insufficient oxygen is present to support combustion of the substrate. The surface of a paper substrate may be higher than the auto ignition temperature of the paper (e.g. the substrate) for brief periods of time. A finely focused laser light may be used to selectively heat a portion of the paper which permits brief supra-ignition temperatures to be realized however with sufficient heat dissipation such that the substrate does not ignite.

The substrate surface temperature may be above 300° C., preferably from 200 to 300° C., more preferably from 210 to 240° C. After exposure to the laser light the paper may have areas of a carbonized or oxidized material which is more darkly colored than the substrate thereby forming an image on the substrate.

Figure 4:
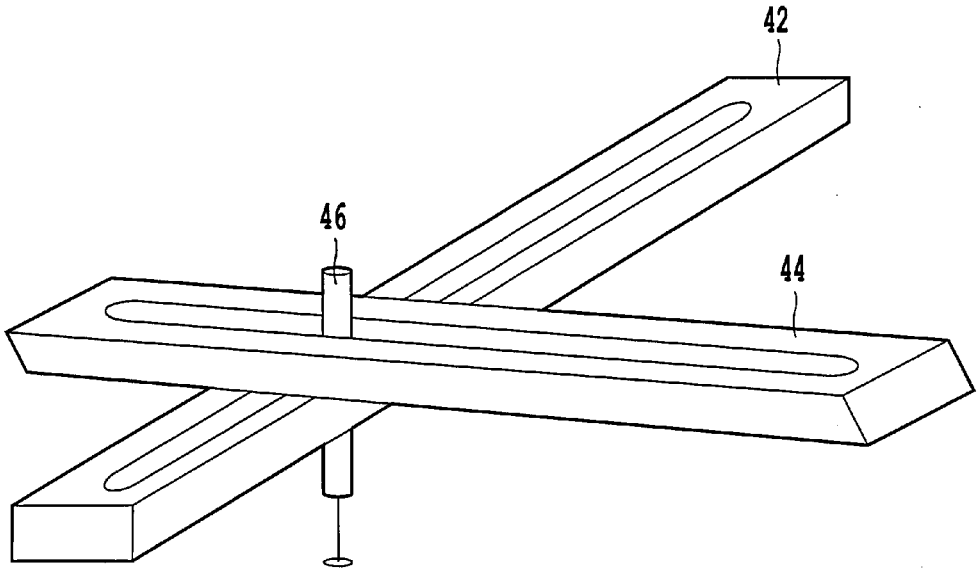
FIG. 4. illustrates a non limiting example depicting the structure of the Blazer printer according to a second embodiment of the present disclosure.
Figure 5:
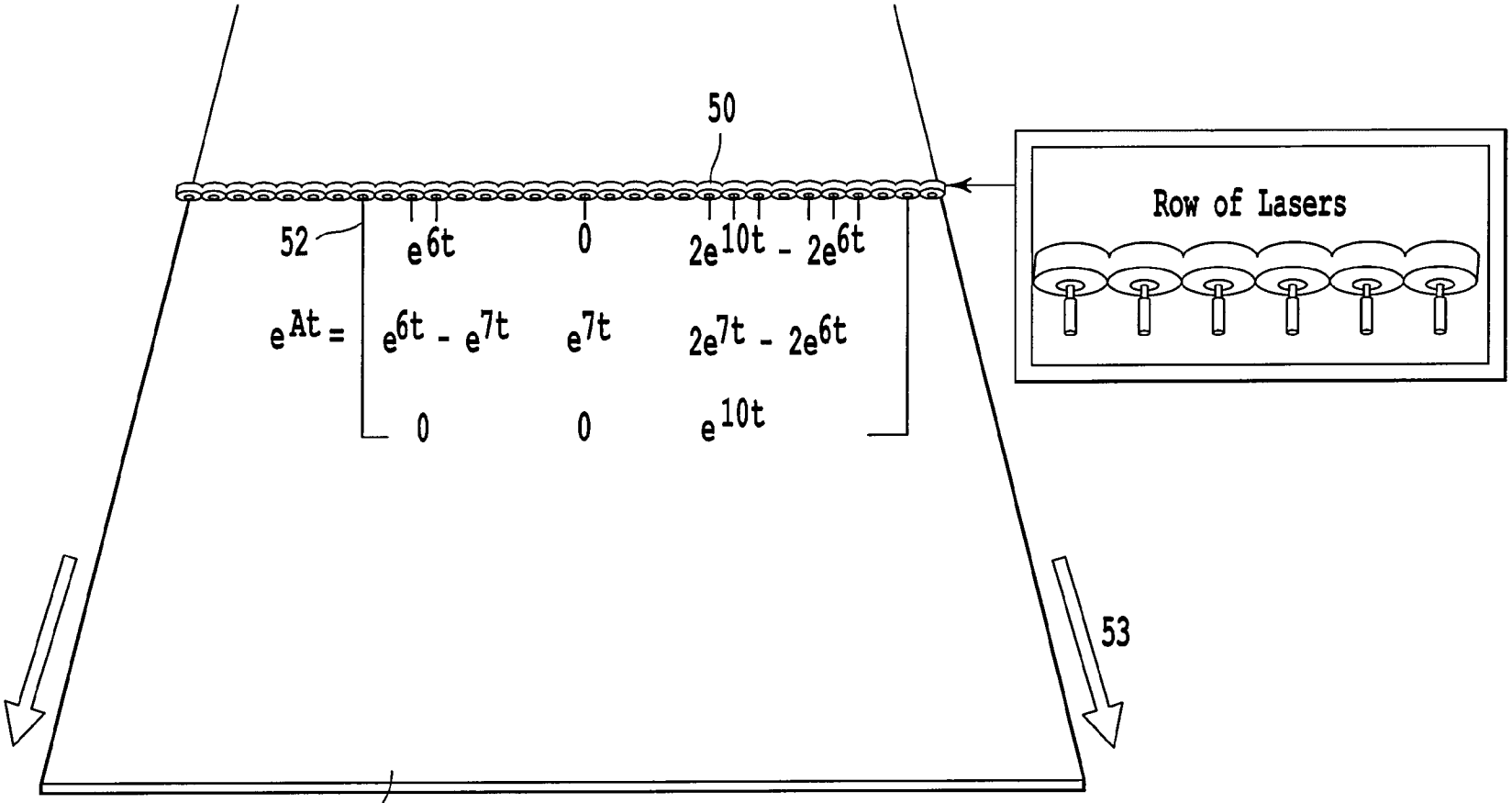
FIG. 5. illustrates a non limiting example depicting the Blazer printer according to a third embodiment of the present disclosure.
Figure 6:
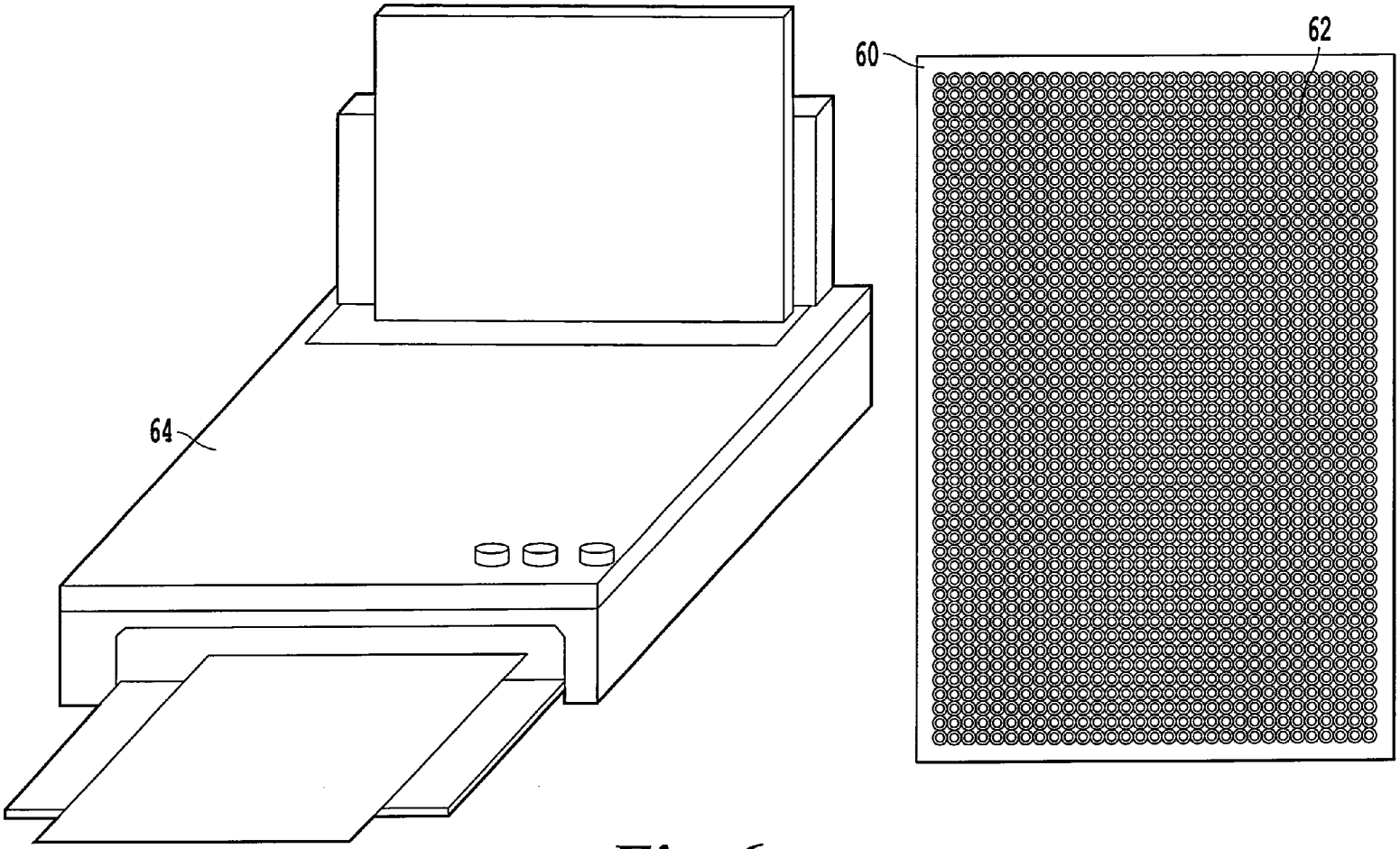
FIG. 6. illustrates a non limiting example depicting the structure of the Blazer printer according to a fourth embodiment of the present disclosure.
Figure 7:
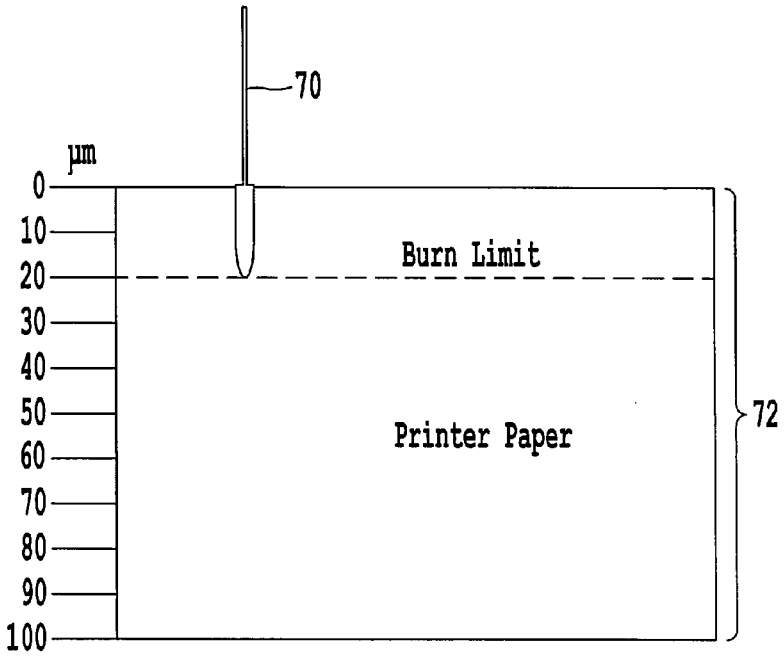
FIG. 7. illustrates a burn limit (depth) of printing using the blazer printer.
Figure 8:
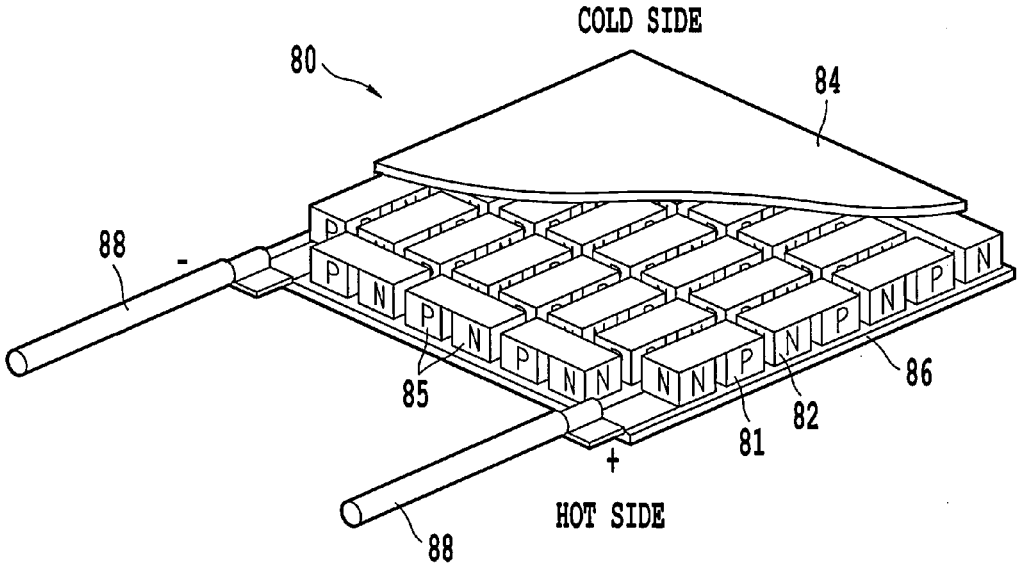
FIG. 8. illustrates a non limiting example depicting the structure an energy recycling component used in the Blazer printer.

In what follows, we explain the other embodiments of the structure of the Blazer printer with reference to FIGS. 4-6 and explain the energy saving mechanism of the Blazer printer with reference to FIGS. 7 and 8.

FIG. 4 depicts a single head movable laser arrangement of the Blazer printer. A laser head 46, is mounted on the intersection of two perpendicular axes, 42 and 44 respectively. A motor (controlled by a controlling unit), moves the laser head in both x and y directions to print anywhere on the paper. Note that the single head design is a simple laser arrangement and is most suitable for individual users who do not print large quantities of information. Table I depicts the advantages/disadvantages of the single head movable laser arrangement of the Blazer printer.

TABLE I

Single head laser arrangement.

| Advantages | Disadvantages |
|---|---|
| Low price | Relatively slow printing rate |
| Small size | Energy wasted in excessive movement |

To achieve faster printing speeds, a plurality of laser heads can be used as shown in FIG. 5, which depicts the laser arrangement of the Blazer printer according to another embodiment of the present disclosure.

FIG. 5 depicts a multiple laser head arrangement wherein multiple laser heads 52, are mounted onto a horizontal beam 50. A controller triggers each laser to turn ON/OFF as the paper rolls underneath the laser, in the direction shown by 53. Thus by using multiple laser heads, energy is consumed as the movement of a single laser is avoided. However, complexity is increased in terms of controlling multiple laser heads to be activated/deactivated in a synchronous manner.

FIG. 6 depicts a full page laser arrangement according to a third embodiment of the present disclosure.

A plurality of laser heads 62, are arranged in a matrix form on a metal frame 60, that is mounted on top of the paper. Note that the surface 60, is located underneath the surface labeled 64 on the Blazer printer. The lasers are triggered simultaneously at different intensities to print an entire page at once. Since no movement of the laser heads is involved, the full page mechanism of using the Blazer printer, achieves maximum printing speeds. It is designed for customers who require industrial heavy duty printing. However, considering the number of laser heads mounted on the metallic frame, the full page mechanism also proves to be a costly approach.

Table II depicts the advantages/disadvantages of the full page laser arrangement of the Blazer printer.

TABLE II

Full page laser arrangement.

| Advantages | Disadvantages |
|---|---|
| Most rapid printing rate | Bulky size |
| Heavy duty printing | Relatively high cost |
| | Relatively high energy consumption |

We now describe the energy recycling component that is used in all the embodiments of the Blazer printer and specifically illustrate how the Blazer printer achieves energy efficiency.

The high energy consumption of modern conventional printers demands a fairly large amount of electricity. Recent studies have shown that it takes about 5.3 Watts of power to print approximately 10 pages. This leads to a power usage of 2.4 kW per hour of printing. This amount of energy is enough to keep a 100-watt light bulb on for 24 hours every time a printer is used for one hour. Further, it is also common to have printers on a stand-by mode, wherein the printer is on and kept warm, but is not performing any printing function. Energy consumed in such a stand-by mode is 0.31 kW per hour approximately. This leads to significant waste of energy resources.

In order to resolve the issue of energy consumption and the production of heat, the Blazer Printer is designed to use minimum energy during printing. Unlike the conventional laser printers, the Blazer printer does not need to heat up every sheet of paper it is printing. Instead, power will only be drawn to provide energy to the laser heads, and to the moving parts of the printer.

Additionally, the Blazer Printer does not have a stand-by mode. The printer is expected to be turned off when not in use, either manually (by using the auto off switch provided near the LED display) or by an automatic timing mechanism.

Further, as stated previously, used ink cartridges and toners from traditional printers can have a negative long-term effect on the ecosystem. Most parts of the toners and cartridges are made out of plastic and the polymers used during the process are non-degradable. Therefore upon the disposal of the cartridges and toners, they are left in the landfill forever. This contributes to the overall electronic and plastic waste. Additionally, the ink and toner dust themselves consist of chemicals that are hazardous to the environment. When disposed, the chemicals will become a serious threat to the environment.

To avoid the above mentioned drawbacks of traditional printers, the Blazer printer consumes much less energy and proves to be eco-friendly. Referring to FIGS. 7-8, we explain how the Blazer printer achieves a high energy efficiency.

As mentioned previously, the Blazer printer prints an image of the data on the sheet of paper by burning the paper to a certain predetermined depth. The combustion of paper will certainly produce carbon dioxide, water vapor and some measure of heat. However, it should be noted that when printing, the Blazer Printer will only burn the paper to a small depth of up to twenty percent of the thickness of the paper. This is shown schematically in FIG. 7, wherein the thickness of the paper, represented by 72 is approximately 100 micrometers and the burn depth (burn limit) is up to 20 micrometers. Therefore, the quantities of these gases will not significantly affect the air quality of the environment in which the printer will be used. Furthermore, the Blazer printer comprises of an energy-recycling-component (ERC) which reuses some of the heat energy dissipated while burning the paper.

FIG. 8 depicts the structure an energy recycling component 80 used in the Blazer printer. As described previously the Blazer printer prints information on a sheet of paper by burning the data on the paper. As more sheets of paper are printed consecutively, the temperature underneath the paper surface increases. In order to decrease the energy consumption, the energy recycling component (ERC) is installed to collect the heat generated during printing, and store it in a battery cell(s). The ERC comprises a plurality of thermoelectric cells that can be used to convert the generated heat during the printing process in to electrical energy that can be used to power the batteries.

Generally, thermoelectric cells draw electricity to create a temperature difference between its two surfaces. However, it can also be used reversely, wherein, given a temperature difference between the two surfaces of the ERC, the thermoelectric cells are capable of producing electricity. FIG. 8 describes the structure of an ERC component that is used in the Blazer printer.

The ERC comprises a plurality of thermo-electric cells which are made of p-type and n-type semiconductor material, represented by units 81 and 82 respectively in FIG. 8. The thermo-electric cells are arranged in a matrix formation between two surfaces 84 and 86 respectively. Each p-type and n-type semiconductor is coated with a conducting material (for example copper) 85. Note that the heat generated during the printing process is accumulated on one surface of the ERC unit. For the sake of illustration, we represent this surface as a hot surface denoted by 86. The temperature difference between the hot surface (86) and the cold surface (84) is used to generate electricity which is used to power a battery cell via the terminals 88.

The ERC can ideally be installed below the paper tray. Further, for better performance, the paper tray can be made out of aluminum to maximize the heat conductivity, so that more heat will be transferred to one surface of the cells. Once the batteries are charged up to certain pre-determined level, a controller can switch the power source of the Blazer printer from AC to the battery. The battery charge value can also be monitored and customized.

The installation of the ERC will effectively decrease the overall power consumption of the Blazer Printer. During heavy duty industrial printing the advantage of power recycling will be more significant since high volume printing generates substantial amount of heat.

Figure 9:
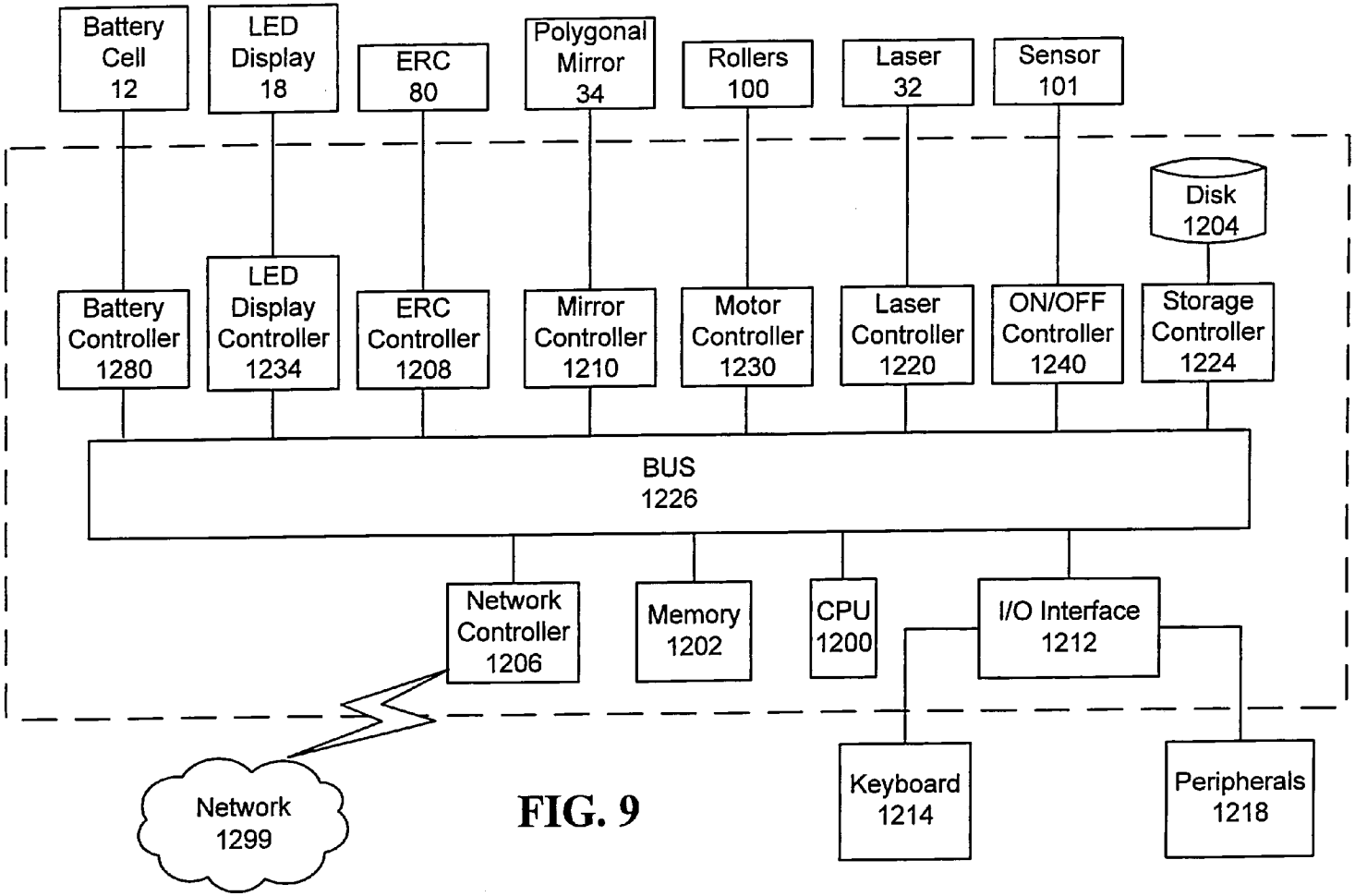
FIG. 9. is an exemplary control processor that assists in the process of printing using the Blazer printer.

FIG. 9 is a block diagram of a controller which may be used to control the different units of the Blazer printer as described in the present disclosure. A hardware description of the controller according to exemplary embodiments is described with reference to FIG. 9.

In FIG. 9, the controller includes CPU 1200 which performs the process described above. The processed data and instructions may be stored in memory 1202. These processes and instructions may also be stored on a storage medium disk 1204 such as a hard drive (HDD) or portable storage medium or may be stored remotely. Further, the claimed advancements are not limited by the form of the computer-readable media on which the instructions of the inventive process are stored. For example, the instructions may be stored on CDs, DVDs, in FLASH memory, RAM, ROM, PROM, EPROM, EEPROM, hard disk or any other information processing device with which the Blazer printer communicates such as a server or computer.

Further, the claimed advancements may be provided as a utility application, background daemon, or component of an operating system, or combination thereof, executing in conjunction with CPU 1200 and an operating system such as Microsoft Windows 7, UNIX, Solaris, LINUX, Apple MAC-OS and other systems known to those skilled in the art.

CPU 1200 may be a Xenon or Core processor from Intel of America or an Opteron processor from AMD of America, or may be other processor types that would be recognized by one of ordinary skill in the art. Alternatively, the CPU 1200 may be implemented on an FPGA, ASIC, PLD or using discrete logic circuits, as one of ordinary skill in the art would recognize. Further, CPU 1200 may be implemented as multiple processors cooperatively working in parallel to perform the instructions of the inventive processes described above.

The controller in FIG. 9 also includes a network controller 1206, such as an Intel Ethernet PRO network interface card from Intel Corporation of America, for interfacing with network 1299. As can be appreciated, the network 1299 can be a public network, such as the Internet, or a private network such as an LAN or WAN network, or any combination thereof and can also include PSTN or ISDN sub-networks. The network 1299 can also be wired, such as an Ethernet network, or can be wireless such as a cellular network including EDGE, 3G and 4G wireless cellular systems. The wireless network can also be WiFi, Bluetooth, or any other wireless form of communication that is known.

A general purpose I/O interface 1212 interfaces with a keyboard 1214 which enables a user to manually input the printing parameters such as setting the margin size, selecting the quality of printing, the speed of printing etc. Further, an interface for peripheral units 1218, such as a USB 2.0/3.0 drive is provided which enables a user to access the USB memory and execute a print function.

The general purpose storage controller 1224 connects the storage medium disk 1204 with communication bus 1226, which may be an ISA, EISA, VESA, PCI, or similar, for interconnecting all of the components of the cane based system.

A LED controller 1234 is provided to interface with the LED display 18. On receiving instructions from the CPU 1200, the LED controller will display pertinent information of the Blazer printer on the LED display unit 18.

An ERC controller 1208 is provided to interface with the ERC component 80 of the Blazer printer. This controller can monitor the working of the ERC component and instruct it to switch the power supply to the Blazer printer from the AC supply to the battery supply, on receiving instructions from the CPU. Specifically, when the controller detects via the battery controller 1280 that the battery cell 12 has reached a certain pre-determined threshold of power, it can instruct the ERC controller to switch the power supply to the battery cell. Further, when the printer is not printing the battery controller can charge the battery cell 12 via the AC supply.

A motor controller 1230 is provided to adjust/detect the operation of the feed rollers which are used to input sheets of paper into the Blazer printer. Upon detecting a malfunction in the rollers the CPU can instruct the Auto ON/OFF controller 1240, to automatically shut down the Blazer printer. Further, the Auto ON/OFF controller can communicate with a sensor 101, (for example a heat sensor) to detect if large amounts of heat that is being generated during the printing process is not being recycled through the ERC. Alternatively, such a heat sensor can be used to power off the Blazer printer to avoid hazardous situations.

The firmware of the Blazer Printer is similar to most conventional printers. However, laser algorithms are precisely programmed into the initial firmware structure for different laser arrangements. The programming of laser heads directly determine the printing quality of the printer. Different laser arrangements require different algorithms, each of which requires large amounts of planning and programming. A laser controller 1220 is provided to control the operation of the laser unit 32.

Further, the polygon mirror rotates at a constant angular velocity to reflect laser beam across the paper. However, as the reflection radius changes, the linear speed of the reflected laser beam varies as well. When the laser dot lands at one side of the paper, the distance between the dot and the laser source is greater than if the dot is in the middle of the paper, or directly underneath the laser head. Thus, as the laser continues to be reflected, its linear velocity increases. Therefore velocity correction codes are required. The Blazer printer's laser head also needs to be able to vary its power and imprint patterns. Aside from velocity correction codes, algorithms that vary the laser power are necessary for the algorithm. Such velocity correction codes and power adjustments can be controlled by the laser controller 1220. Furthermore, the adjustments of the rotation speed of the polygonal rotating mirror 34, can be controlled by the polygonal mirror controller 1210, to print contents of different qualities. Finally, the Blazer printer is programmed to accept Microsoft, iWork, .pdf, .jpg, .jpeg, .png, .gif, and .bmp file formats. The Blazer Printer is made compatible with both Mac OS and Windows operating systems by using the technology of Plug and Play, wherein the user simply can connect the printer USB cord to the computer, and the Blazer Printer would automatically install its software.

A description of the general features and functionality of the keyboard and/or mouse 1214, as well as the storage controller 1224, network controller 1206, sound controller 1220, and general purpose I/O interface 1212 is omitted herein for brevity as these features are known.

Thus, the foregoing discussion discloses and describes merely exemplary embodiments of the present invention. As will be understood by those skilled in the art, the present invention may be embodied in other specific forms without departing from the spirit or essential characteristics thereof. Accordingly, the disclosure of the present invention is intended to be illustrative, but not limiting of the scope of the invention, as well as other claims. The disclosure, including any readily discernible variants of the teachings herein, define, in part, the scope of the foregoing claim terminology such that no inventive subject matter is dedicated to the public.

The invention claimed is:

1. An inkless printer comprising:

a stationary laser configured to emit a beam of a desired power intensity;

a polygonal shaped rotating mirror configured to direct the beam to a paper;

a lens configured to focus the laser beam to a point on the paper and print data on the paper by burning the paper;

an energy recycling component that includes a plurality of thermoelectric cells and is configured to convert heat energy generated by burning the paper to electric energy used to charge a battery;

an AC power supply configured to power the inkless printer;

a LED display configured to display the inkless printer settings and a battery charge level; and a controller configured to switch the power supply to the inkless printer from AC power supply to a battery upon detecting that the battery charge level is equal to a predetermined threshold.

2. The inkless printer of claim 1, wherein a position of the polygonal shaped rotating mirror can be adjusted corresponding to a margin setting of the paper.

3. The inkless printer of claim 1, wherein the printer prints data by burning up to twenty percent of the papers thickness.

4. The inkless printer of claim 1, wherein the energy recycling component comprises a plurality of p-type and n-type semiconductors, a dielectric material and a pair of terminals that are connected to the battery.

5. The inkless printer of claim 1, further comprises a plurality of rollers and a stepper motor configured to guide the paper through a feed tray to the inkless printer.

6. The inkless printer of claim 1, further comprises a plurality of USB data ports to print data directly from a USB memory.

7. The inkless printer of claim 1, wherein the controller is configured to power off the inkless printer on detecting at least one of a paper jam and an unexpected roller stoppage.

8. The inkless printer of claim 1, wherein the exterior casing of the printer is made from recycled plastic.

9. The inkless printer of claim 1, wherein the energy recycling component is positioned underneath a receiving tray.

* * * * *